US011215003B2

(12) United States Patent
Nash

(10) Patent No.: US 11,215,003 B2
(45) Date of Patent: Jan. 4, 2022

(54) GATE OPENING AND CLOSING ASSEMBLY

(71) Applicant: Christopher Nash, Veneta, OR (US)

(72) Inventor: Christopher Nash, Veneta, OR (US)

( * ) Notice: Subject to any disclaimer, the term of this patent is extended or adjusted under 35 U.S.C. 154(b) by 252 days.

(21) Appl. No.: 16/433,491

(22) Filed: Jun. 6, 2019

(65) Prior Publication Data

US 2020/0386029 A1 Dec. 10, 2020

(51) Int. Cl.
*E05F 15/603* (2015.01)
*E05F 15/635* (2015.01)
*E05F 15/619* (2015.01)

(52) U.S. Cl.
CPC ..... *E05F 15/603* (2015.01); *E05F 15/619* (2015.01); *E05F 15/635* (2015.01); *E05Y 2400/614* (2013.01); *E05Y 2400/628* (2013.01); *E05Y 2900/40* (2013.01)

(58) Field of Classification Search
CPC ..... E05F 15/603; E05F 15/611
USPC ..... 49/358
See application file for complete search history.

(56) References Cited

U.S. PATENT DOCUMENTS 1,326,995 A * 1/1920 Tomkinson ..... E05F 15/635 49/358
1,694,431 A * 12/1928 Russell ..... E05F 15/624 49/358
2,827,284 A * 3/1958 Bunzl ..... E05F 15/624 49/32
3,606,699 A * 9/1971 Robinson ..... E05F 15/635 49/280
4,231,190 A 11/1980 Tieben
4,416,085 A 11/1983 Lybecker
4,520,592 A * 6/1985 Holloway ..... E05F 15/624 49/25
4,658,543 A 4/1987 Carr
4,672,773 A * 6/1987 Bilt ..... E05F 15/641 49/358
4,754,572 A * 7/1988 Bilt ..... E05F 15/632 49/358
6,135,190 A 10/2000 Gompertz
6,655,090 B2 12/2003 Regner
7,021,005 B1 * 4/2006 Curry ..... E05F 15/624 49/358
7,083,357 B2 8/2006 Lamore
7,367,161 B1 5/2008 Jones
10,081,977 B2 * 9/2018 Shelley ..... E05F 15/611
2002/0088181 A1 7/2002 Friesen
2013/0318878 A1 * 12/2013 Manseder ..... E05F 15/624 49/358

(Continued)

*Primary Examiner* — Gregory J Strimbu

(57) ABSTRACT

A gate opening and closing assembly includes a mount that is coupled to a vertical member of a gate that is extendable across an entry way. A drive unit is coupled to the mount and the drive unit is actuated to rotate in a first direction or a second direction. A wheel is rotatably coupled to the drive unit to roll along the ground. The wheel is rotated in an opening direction when the drive unit rotates in the first direction to urge the gate into an open position thereby facilitating a vehicle to drive through the entry way. The wheel is rotated in a closing direction when the drive unit rotates in the second direction to urge the gate into a closed position thereby inhibiting the vehicle from driving through the entry way. A remote control is in wireless electrical communication with the drive unit. The remote control turns the drive unit on and off to open and close the gate.

14 Claims, 6 Drawing Sheets

(56) References Cited

U.S. PATENT DOCUMENTS

| | | | | |
|---|---|---|---|---|
| 2016/0237746 | A1 | 8/2016 | Schirado | |
| 2019/0292829 | A1* | 9/2019 | Sellinger | E05F 15/611 |

* cited by examiner

GATE OPENING AND CLOSING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to gate devices and more particularly pertains to a new gate device for remotely opening and closing a roadway gate.

BRIEF SUMMARY OF THE INVENTION

An embodiment of the disclosure meets the needs presented above by generally comprising a mount that is coupled to a vertical member of a gate that extends across an entry way. A drive unit is coupled to the mount and the drive unit is actuated to rotate in a first direction or a second direction. A wheel is rotatably coupled to the drive unit to roll along the ground. The wheel is rotated in an opening direction when the drive unit rotates in the first direction to urge the gate into an open position thereby facilitating a vehicle to drive through the entry way. The wheel is rotated in a closing direction when the drive unit rotates in the second direction to urge the gate into a closed position thereby inhibiting the vehicle from driving through the entry way. A remote control is in wireless electrical communication with the drive unit. The remote control turns the drive unit on and off to open and close the gate.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
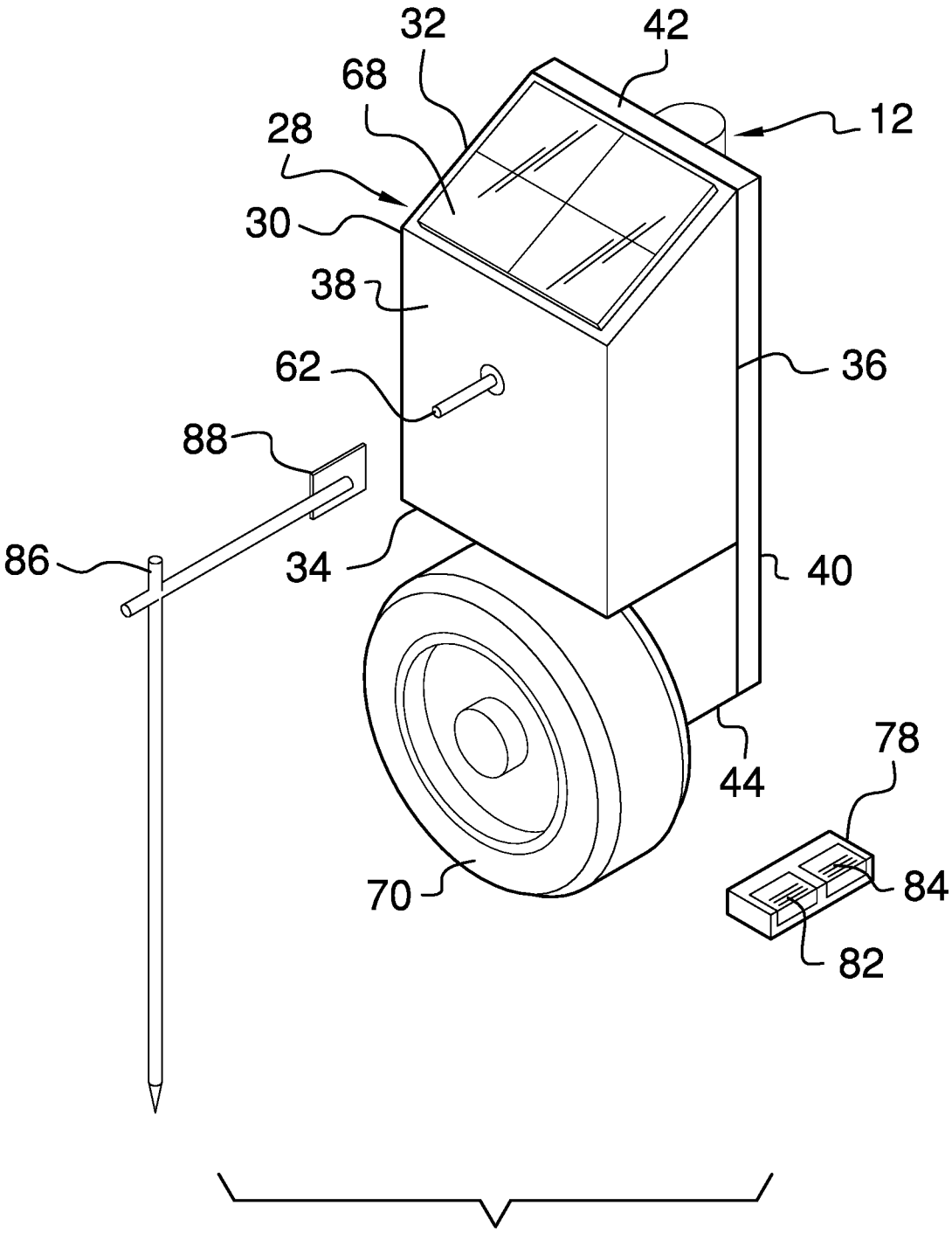
FIG. 1 is a perspective view of a gate opening and closing assembly according to an embodiment of the disclosure.
Figure 2:
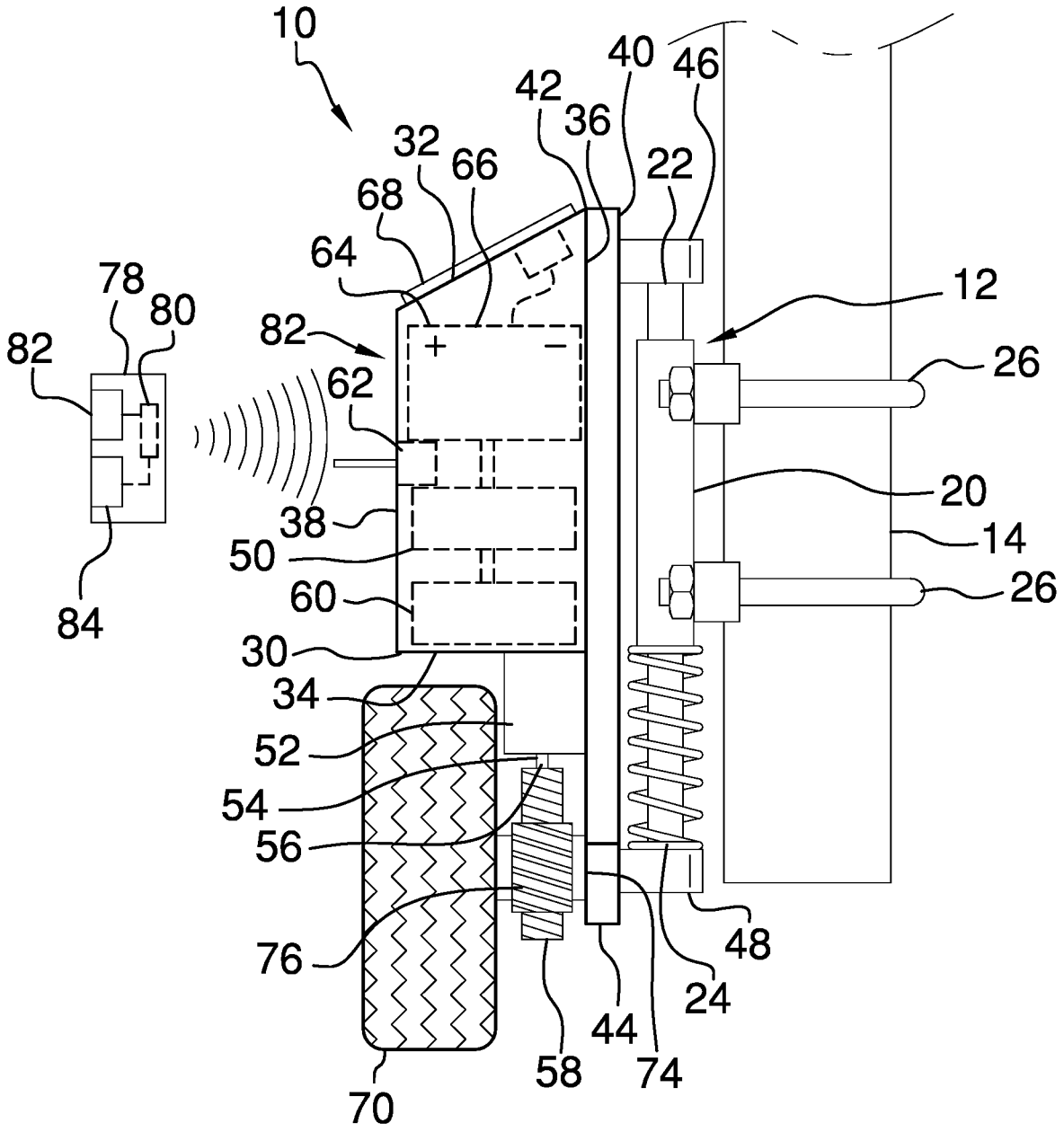
FIG. 2 is a phantom view of an embodiment of the disclosure.
Figure 3:
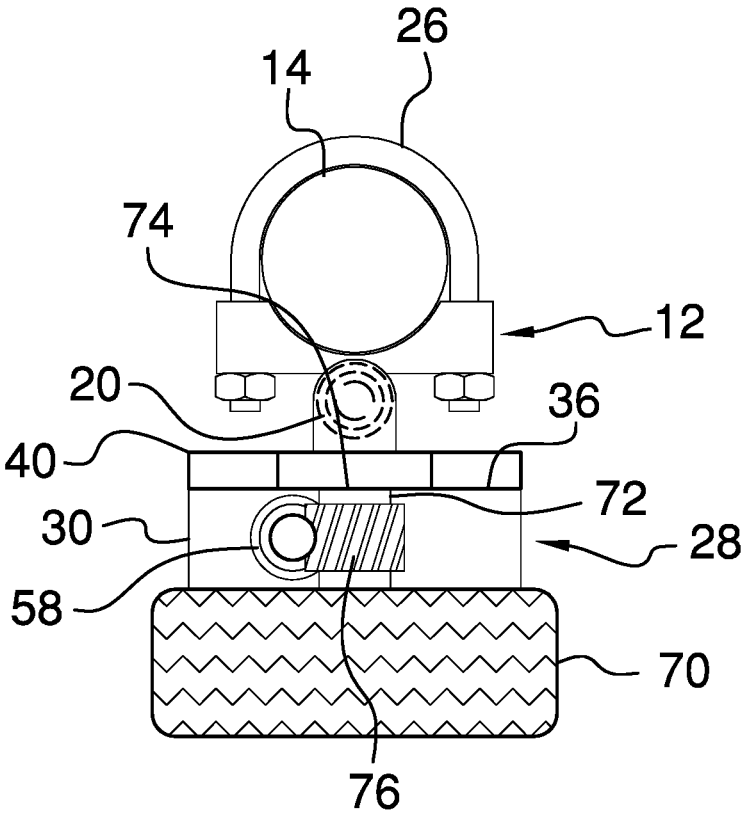
FIG. 3 is a bottom view of an embodiment of the disclosure.
Figure 4:
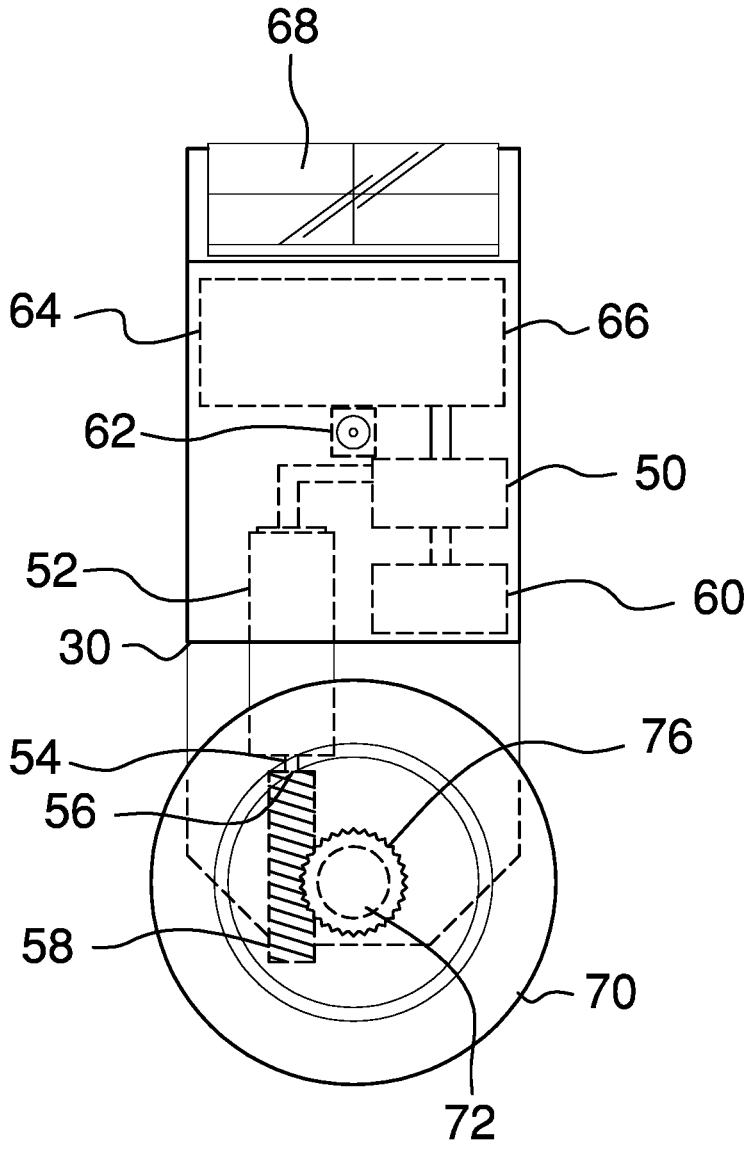
FIG. 4 is a left side phantom view of an embodiment of the disclosure.
Figure 5:
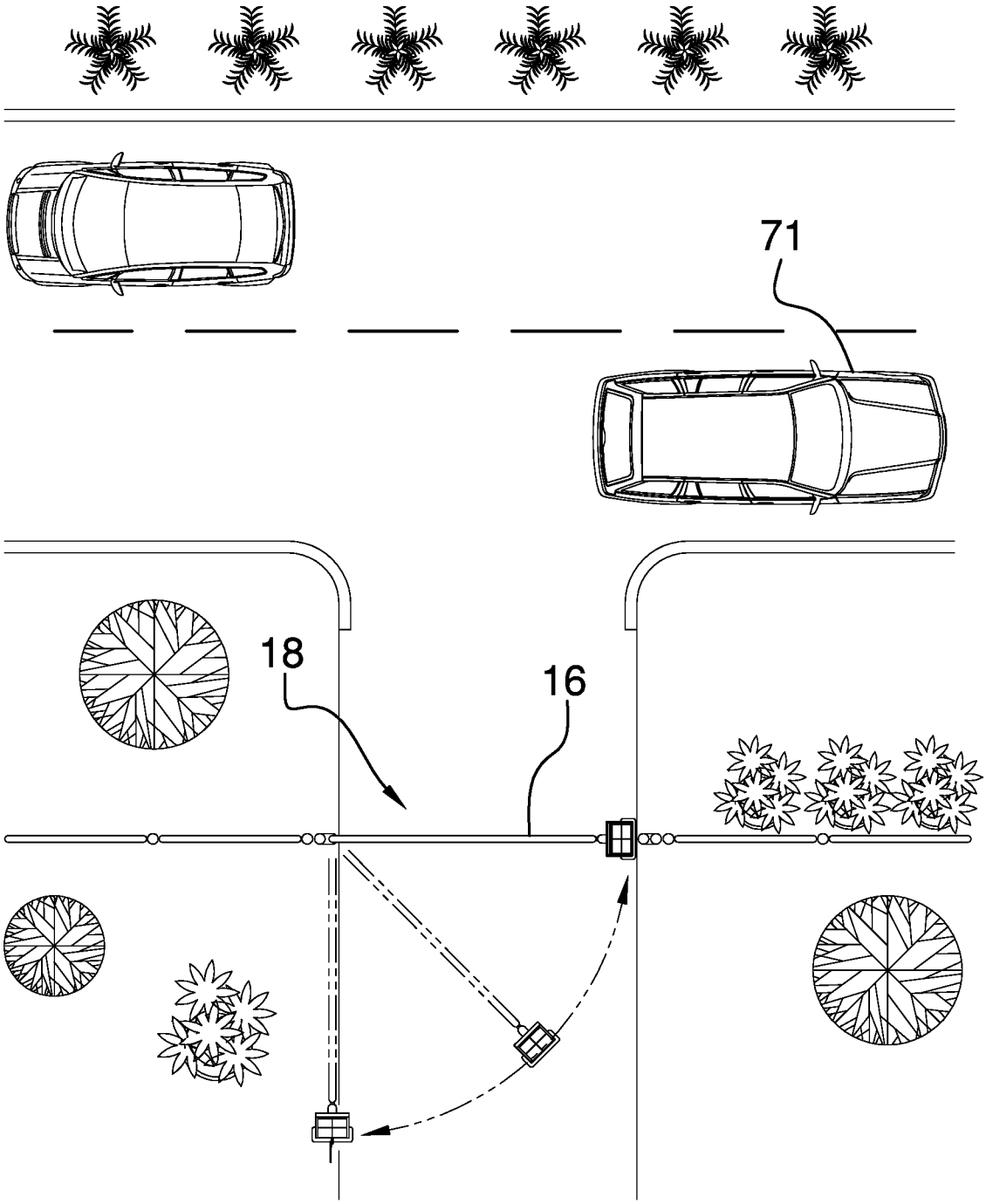
FIG. 5 is a perspective in-use view of an embodiment of the disclosure.

With reference now to the drawings, and in particular to FIGS. 1 through 6 thereof, a new gate device embodying the principles and concepts of an embodiment of the disclosure and generally designated by the reference numeral 10 will be described.

As best illustrated in FIGS. 1 through 6, the gate opening and closing assembly 10 generally comprises a mount 12 that is coupled to a vertical member 14 of a gate 16 that extends across an entry way 18. The entry way 18 might be a driveway into a private residence, a driveway into a gated community or a roadway leading into any secured location. Additionally, the gate 16 may be a roadway gate of any conventional design that can be hingedly positioned between an open position or a closed position with respect to the entry way 18.

The mount 12 comprises a shock absorber 20 that has a top end 22 and a bottom end 24, and the shock absorber 20 is elongated between the top 22 and bottom 24 ends.

Moreover, the shock absorber 20 is resiliently compressible between the top 22 and bottom 24 ends. The shock absorber 20 may be a gas charged shock absorber, a spring loaded shock absorber or any other type of shock absorber that has a travel length ranging between approximately 2.0 inches and 4.0 inches.

A pair of fasteners 26 is each coupled around the vertical member 14 of the gate 16. Each of the fasteners 26 engages the shock absorber 20 for retaining the shock absorber 20 on the vertical member 14 of the gate 16. The shock absorber 20 is vertically oriented on the vertical member 14 of the gate 16 such that the bottom end 24 of the shock absorber 20 is directed toward ground. Each of the fasteners 26 may include, but not be limited to, U-bolts, releasable straps, nuts and bolts or any other releasable fastener that can engage a structural member of the gate 16.

A drive unit 28 is provided and the drive unit 28 is coupled to the mount 12. In this way the drive unit 28 is retained on the vertical member 14 of the gate 16. The drive unit 28 can be actuated to rotate in a first direction or a second direction.

The drive unit 28 comprises a housing 30 that has a top wall 32, a bottom wall 34, a back wall 36 and a front wall 38. The top wall 32 slopes downwardly between the back wall 36 and the front wall 38. The drive unit 28 includes a frame 40 which has a topmost end 42 and a bottommost end 44, and the frame 40 is coupled to the back wall 36 of the housing 30. The topmost end 42 is aligned with the top wall 32 and the bottommost end 44 is spaced downwardly from the bottom wall 34.

The drive unit 28 includes a first attachment 46 that is coupled to and extends away from the frame 40 such that the first attachment 46 extends away from the back wall 36 of the housing 30. The first attachment 46 is aligned with the topmost end 42 of the frame 40 and the first attachment 46 has the top end 22 of the shock absorber 20 being coupled thereto. The drive unit 28 includes a second attachment 48 that is coupled to and extends away from the frame 40 such that the second attachment 48 extends away from the back wall 36 of the housing 30. The second attachment 48 is aligned with the bottommost end 44 of the frame 40 and the second attachment 48 has the bottom end 24 of the shock absorber 20 is coupled thereto. Additionally, the frame 40 and the housing 30 can each travel along an axis extending through the top 22 and bottom 24 ends of the shock absorber 20 when the shock absorber 20 is compressed between the top 22 and bottom 24 ends.

The drive unit 28 includes a control circuit 50 that is positioned within the housing 30. The control circuit 50 receives an open input, a close input and a stop input. The drive unit 28 includes a motor 52 that is coupled to the housing 30 and the motor 52 is electrically coupled to the control circuit 50. The motor 52 is turned on to rotate in a first direction when the control circuit 50 receives the open input. The motor 52 is turned on to rotate in a second direction when the control circuit 50 receives the close input. Additionally, the motor 52 is turned off when the control circuit 50 receives the stop input. The motor 52 may comprise an electric motor or the like.

The drive unit 28 includes a drive shaft 54 that is rotatably coupled to the motor 52 such that the motor 52 rotates the drive shaft 54 when the motor 52 is turned on. The drive shaft 54 extends along an axis extending through the top 32 and bottom 34 walls of the housing 30. Additionally, the drive shaft 54 has a distal end 56 with respect to the motor 52. The drive unit 28 includes a worm gear 58 that is coupled to the distal end 56 of the drive shaft 54. Thus, the worm gear 58 is rotated about the axis extending through the top 32 and bottom 34 walls of the housing 30 when the motor 52 is turned on.

The drive unit 28 includes a receiver 60 that is positioned within the housing 30, and the receiver 60 is electrically coupled to the control circuit 50. The receiver 60 may comprise a radio frequency receiver or the like. The drive unit 28 includes a limit switch 62 that is coupled to the housing 30. The limit switch 62 extends outwardly through the front wall 38 of the housing 30 and the limit switch 62 is electrically coupled to the control circuit 50. Moreover, the control circuit 50 receives the stop input when the limit switch 62 is turned on. The limit switch 62 may comprise, but not be limited to, a mechanical switch, an optical switch or any other type of switch that can be turned on and off.

The drive unit 28 includes a power supply 64 that is coupled to the housing 30 and the power supply 64 is electrically coupled to the control circuit 50. The power supply 64 comprises at least one rechargeable battery 66 that is positioned within the housing 30. The at least one rechargeable battery 66 is electrically coupled to the control circuit 50, and the at least one rechargeable battery 66 may have an operational voltage of approximately 12.0 VDC. The power supply 64 includes a solar panel 68 that is coupled to the top wall 32 of the housing 30 such that the solar panel 68 is exposed to sunlight. The solar panel 68 is electrically coupled to the at least one rechargeable battery 66 such that the solar panel 68 charges the at least one rechargeable battery 66.

A wheel 70 is rotatably coupled to the drive unit 28 such that the wheel 70 rolls along the ground. The wheel 70 is rotated in an opening direction when the drive unit 28 rotates in the first direction. In this way the wheel 70 urges the gate 16 into an open position thereby facilitating a vehicle 71 to drive through the entry way 18. The wheel 70 is rotated in a closing direction when the drive unit 28 rotates in the second direction. In this way the wheel 70 urges the gate 16 into a closed position thereby inhibiting the vehicle 71 from driving through the entry way 18. Moreover, the wheel 70 ceases rotating when the motor 52 is turned off. The wheel 70 may be a solid rubber wheel, an inflatable rubber wheel or any other type of wheel that can roll along a variety of types of terrain.

An axle 72 is coupled to the wheel 70 and the axle 72 is oriented to extend along a horizontal axis. The axle 72 has a distal end 74 with respect to the wheel 70 and the distal end 74 of the axle 72 is rotatably coupled to the frame 40. Additionally, the distal end 74 of the axle 72 is aligned with the bottommost end 44 of the frame 40 and the axle 72 is aligned with the worm gear 58 on the drive shaft 54. A drive gear 76 is coupled around the axle 72 and the drive gear 76 engages the worm gear 58. The drive gear 76 rotates the wheel 70 in the opening direction when the motor 52 is turned on to rotate in the first direction. Additionally, the drive gear 76 rotates the wheel 70 in the closing direction when the motor 52 is turned on to rotate in the second direction.

A remote control 78 is provided and the remote control 78 is in wireless electrical communication with the drive unit 28. The remote control 78 turns the drive unit 28 on and off to open and close the gate 16. The remote control 78 may be carried by a driver of the vehicle 71 that is approaching the gate 16. In this way the driver of the vehicle 71 can open or close the gate 16 without having to exit the vehicle 71 and manually manipulate the gate 16.

The remote control 78 comprises a transmitter 80 that is positioned within the remote control 78 and the transmitter 80 is in electrical communication with the receiver 60. Additionally, the transmitter 80 may comprise a radio frequency transmitter 80 or the like. An open button 82 is movably coupled to the remote control 78 and the open button 82 is electrically coupled to the transmitter 80. The transmitter 80 broadcasts an open command to the receiver 60 when the open button 82 is depressed. Moreover, the control circuit 50 receives the open input when the receiver 60 receives the open command. A close button 84 is movably coupled to the remote control 78 and the close button 84 is electrically coupled to the transmitter 80. The transmitter 80 broadcasts a close command to the receiver 60 when the close button 84 is depressed. Additionally, the control circuit 50 receives the close input when the receiver 60 receives the close command.

Figure 6:
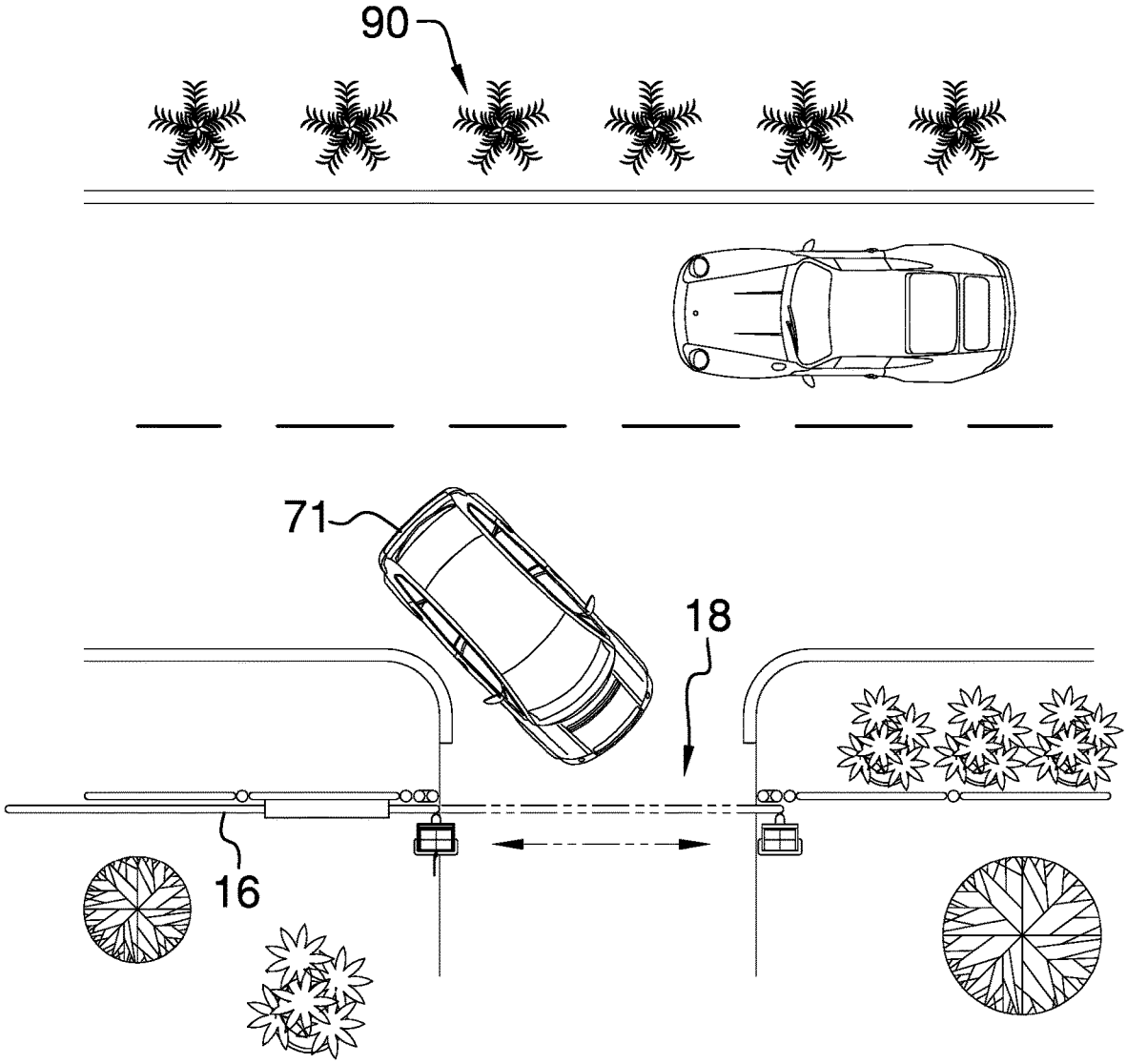
FIG. 6 is a perspective in-use view of an alternative embodiment of the disclosure.

As is most clearly shown in FIG. 1, a stop 86 may be provided and the stop 86 can be inserted into the ground at a pre-determined point of travel with respect to the gate 16. The limit switch 62 may engage the stop 86 when the gate 16 is fully opened. In this way the limit switch 62 is turned on to turn the motor 52 off. The stop 86 might include a reflector 88 or other optic device that facilitates the limit switch 62 to detect the reflector 88 if the limit switch 62 is an optical switch. The limit switch 62 engages a structure, such as a fence post or the like, when the gate 16 is fully closed. In an alternative embodiment 90 as is shown in FIG. 6, the gate may be a sliding type of gate that slides back and forth across the entry way 18.

In use, the mount 12, the drive unit 28 and the wheel 70 are each attached to the vertical member 14 of any existing driveway gate 16. Additionally, the at least one rechargeable battery 66 and the solar panel 68 facilitate the drive unit 28 to be powered without the need to run a power cord, or other source of electrical power, to the drive unit 28. The driver of the vehicle 71 carries the remote control 78 and manipulates the remote control 78 to either open or close the gate 16. In this way the driver of the vehicle 71 can open or close the gate 16 without exiting the vehicle 71 to manually manipulate the gate 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A gate opening and closing assembly comprising:

a mount being coupled to a vertical member of a gate that is extendable across an entry way, said mount comprising a shock absorber having a top end and a bottom end, said shock absorber being elongated between said top and bottom ends, said shock absorber being resiliently compressible between said top and bottom ends;

a drive unit being coupled to said mount wherein said drive unit is configured to be retained on the vertical member of the gate, said drive unit being actuated to rotate in a first direction or a second direction, said drive unit comprising a housing having a top wall, a bottom wall, a back wall and a front wall, said top wall sloping downwardly between said back wall and said front wall;

a wheel being rotatably coupled to said drive unit wherein said wheel is configured to roll along the ground, said wheel being rotated in an opening direction when said drive unit rotates in said first direction wherein said wheel is configured to urge the gate into an open position thereby allowing a vehicle to drive through the entry way, said wheel being rotated in a closing direction when said drive unit rotates in said second direction wherein said wheel is configured to urge the gate into a closed position thereby inhibiting the vehicle from driving through the entry way;

a remote control being in wireless electrical communication with said drive unit, said remote control being configured to turn said drive unit on and off wherein said remote control is configured to control the drive unit to move the gate between the open and closed positions;

a frame having a topmost end and a bottommost end, said frame being coupled to said back wall of said housing, said topmost end being aligned with said top wall, said bottommost end being spaced downwardly from said bottom wall;

a control circuit being positioned within said housing; and a limit switch being coupled to said housing, said limit switch extending outwardly through said front wall of said housing, said limit switch being electrically coupled to said control circuit, said control circuit receiving a stop input when said limit switch s turned on.

2. The assembly according to claim 1, wherein said mount further comprises a pair of fasteners, each of said fasteners being configured to be coupled around the vertical member of the gate, each of said fasteners engaging said shock absorber for retaining said shock absorber on the vertical member of the gate, said shock absorber being vertically oriented on the vertical member of the gate.

3. The assembly according to claim 1, further comprising:

a first attachment being coupled to and extending away from said frame such that said first attachment extends away from said back wall of said housing, said first attachment being aligned with said topmost end of said frame, said first attachment having said top end of said shock absorber coupled thereto; and a second attachment being coupled to and extending away from said frame such that said second attachment extends away from said back wall of said housing, said second attachment being aligned with said bottommost end of said frame, said second attachment having said bottom end of said shock absorber coupled thereto, wherein said frame and said housing can each travel along an axis extending through said top and bottom ends of said shock absorber when said shock absorber is compressed between said top and bottom ends.

4. The assembly according to claim 1, further comprising a motor being coupled to said housing, said motor being electrically coupled to said control circuit, said motor being turned on to rotate in the first direction when said control circuit receives an open input, said motor being turned on to rotate in the second direction when said control circuit receives a close input, said motor being turned off when said control circuit receives said stop input.

5. The assembly according to claim 4, further comprising a drive shaft being rotatably coupled to said motor such that said motor rotates said drive shaft when said motor is turned on, said drive shaft extending along an axis extending through said top and bottom walls of said housing, said drive shaft having a distal end with respect to said motor.

6. The assembly according to claim 5, further comprising a worm gear being coupled to said distal end of said drive shaft such that said worm gear is rotated about said axis extending through said top and bottom walls of said housing when said motor is turned on.

7. The assembly according to claim 6, further comprising an axle being coupled to said wheel, said axle being oriented to extend along a horizontal axis, said axle having a distal end with respect to said wheel, said distal end of said axle being rotatably coupled to said frame, said distal end of said axle being aligned with said bottommost end of said frame, said axle being aligned with said worm gear on said drive shaft.

8. The assembly according to claim 7, further comprising a drive gear being coupled around said axle, said drive gear engaging said worm gear, said drive gear rotating said wheel in said opening direction when said motor is turned on to rotate in said first direction, said drive gear rotating said wheel in said closing direction when said motor is turned on to rotate in said second direction.

9. The assembly according to claim 1, further comprising a power supply being coupled to said housing, said power supply being electrically coupled to said control circuit, said power supply comprising:

at least one rechargeable battery being positioned within said housing, said at least one rechargeable battery being electrically coupled to said control circuit; and a solar panel being coupled to said top wall of said housing wherein said solar panel is configured to be exposed to sunlight, said solar panel being electrically coupled to said at least one rechargeable battery such that said solar panel charges said at least one rechargeable battery.

10. The assembly according to claim 1, further comprising a receiver being positioned within said housing, said receiver being electrically coupled to said control circuit.

11. The assembly according to claim 10, wherein said remote control comprises a transmitter being positioned within said remote control, said transmitter being in electrical communication with said receiver.

12. The assembly according to claim 11, further comprising an open button being movably coupled to said remote control, said open button being electrically coupled to said transmitter, said transmitter broadcasting an open command to said receiver when said open button is depressed, said control circuit receiving an open input when said receiver receives said open command.

13. The assembly according to claim 12, further comprising a close button being movably coupled to said remote control, said close button being electrically coupled to said transmitter, said transmitter broadcasting a close command to said receiver when said close button is depressed, said control circuit receiving a close input when said receiver receives said close command.

14. A gate opening and closing assembly comprising:

a mount being coupled to a vertical member of a gate that is extendable across an entry way, said mount comprising:

a shock absorber having a top end and a bottom end, said shock absorber being elongated between said top and bottom ends, said shock absorber being resiliently compressible between said top and bottom ends; and a pair of fasteners, each of said fasteners being configured to be coupled around the vertical member of the gate, each of said fasteners engaging said shock absorber for retaining said shock absorber on the vertical member of the gate, said shock absorber being vertically oriented on the vertical member of the gate;

a drive unit being coupled to said mount wherein said drive unit is configured to be retained on the vertical member of the gate, said drive unit being actuated to rotate in a first direction or a second direction, said drive unit comprising:

a housing having a top wall, a bottom wall, a back wall and a front wall, said top wall sloping downwardly between said back wall and said front wall;

a frame having a topmost end and a bottommost end, said frame being coupled to said back wall of said housing, said topmost end being aligned with said top watt, said bottommost end being spaced downwardly from said bottom wall;

a first attachment being coupled to and extending away from said frame such that said first attachment extends away from said back wall of said housing, said first attachment being aligned with said topmost end of said frame, said first attachment having said top end of said shock absorber coupled thereto, a second attachment being coupled to and extending away from said frame such that said second attachment extends away from said back wall of said housing, said second attachment being aligned with said bottommost end of said frame, said second attachment having said bottom end of said shock absorber coupled thereto, wherein said frame and said housing can each travel along an axis extending through said top and bottom ends of said shock absorber when said shock absorber is compressed between said top and bottom ends;

a control circuit being positioned within said housing, said control circuit configured to receive an open input, a close input and a stop input;

a motor being coupled to said housing, said motor being electrically coupled to said control circuit, said motor being turned on to rotate in the first direction when said control circuit receives said open input, said motor being turned on to rotate in the second direction when said control circuit receives said close input, said motor being turned off when said control circuit receives said stop input;

a drive shaft being rotatably coupled to said motor such that said motor rotates said drive shaft when said motor is turned on, said drive shaft extending along an axis extending through said top and bottom walls of said housing, said drive shaft having a distal end with respect to said motor;

a worm gear being coupled to said distal end of said drive shaft such that said worm gear is rotated about said axis extending through said top and bottom walls of said housing when said motor is turned on;

a receiver being positioned within said housing, said receiver being electrically coupled to said control circuit;

a limit switch being coupled to said housing, said limit switch extending outwardly through said front wall of said housing, said limit switch being electrically coupled to said control circuit, said control circuit receiving said stop input when said limit switch is turned on; and a power supply being coupled to said housing, said power supply being electrically coupled to said control circuit, said power supply comprising:

at least one rechargeable battery being positioned within said housing, said at least one rechargeable battery being electrically coupled to said control circuit; and a solar panel being coupled to said top wall of said housing wherein said solar panel is configured to be exposed to sunlight, said solar panel being electrically coupled to said at least one rechargeable battery such that said solar panel charges said at least one rechargeable battery;

a wheel being rotatably coupled to said drive unit wherein said wheel is configured to roll along the ground, said wheel being rotated in an opening direction when said drive unit rotates in said first direction wherein said wheel is configured to urge the gate into an open position thereby allowing a vehicle to drive through the entry way, said wheel being rotated in a closing direction when said drive unit rotates in said second direction wherein said wheel is configured to urge the gate into a closed position thereby inhibiting the vehicle from driving through the entry way;

an axle being coupled to said wheel, said axle being oriented to extend along a horizontal axis, said axle having a distal end with respect to said wheel, said distal end of said axle being rotatably coupled to said frame, said distal end of said axle being aligned with said bottommost end of said frame, said axle being aligned with said worm gear on said drive shaft;

a drive gear being coupled around said axle, said drive gear engaging said worm gear, said drive gear rotating said wheel in said opening direction when said motor is turned on to rotate in said first direction, said drive gear rotating said wheel in said closing direction when said motor is turned on to rotate in said second direction; and a remote control being in wireless electrical communication with said drive unit, said remote control being configured to turn said drive unit on and off wherein said remote control is configured to control the drive unit to move the gate between the open and closed positions, said remote control comprising:

a transmitter being positioned within said remote control, said transmitter being in electrical communication with said receiver;

an open button being movably coupled to said remote control, said open button being electrically coupled to said transmitter, said transmitter broadcasting an open command to said receiver when said open button is depressed, said control circuit receiving said open input when said receiver receives said open command; and a close button being movably coupled to said remote control, said close button being electrically coupled to said transmitter, said transmitter broadcasting a close command to said receiver when said close button is depressed, said control circuit receiving said close input when said receiver receives said close command.

* * * * *